United States Patent [19]

Tate

[11] Patent Number: 4,824,012

[45] Date of Patent: Apr. 25, 1989

[54] AIR FLOW DAMPER CONTROL SYSTEM

[75] Inventor: Billy G. Tate, Chattanooga, Tenn.

[73] Assignee: United Enertech Corporation, Chattanooga, Tenn.

[21] Appl. No.: 185,060

[22] Filed: Apr. 22, 1988

[51] Int. Cl.[4] ..... F24F 13/10

[52] U.S. Cl. ..... 236/49.5; 137/624.11; 236/51; 318/16

[58] Field of Search ..... 236/49 D, 51; 251/129.04; 137/624.11; 318/16; 340/825.69, 825.72

[56] References Cited

U.S. PATENT DOCUMENTS

| | | | |
|---|---|---|---|
| 3,159,212 | 12/1964 | Patrick | 236/1 C X |
| 3,366,855 | 1/1968 | Huber et al. | 318/16 |
| 3,506,033 | 4/1970 | Haney | 137/624.11 |
| 3,877,639 | 4/1975 | Wilson et al. | 236/51 X |
| 4,279,381 | 7/1981 | Freeh | 237/81 |
| 4,315,596 | 2/1982 | Johnson, Jr. et al. | 236/94 |
| 4,362,270 | 12/1982 | Cleary et al. | 236/51 X |
| 4,433,719 | 2/1984 | Cherry et al. | 236/51 X |

*Primary Examiner*—William E. Tapolcai
*Attorney, Agent, or Firm*—Alan Ruderman

[57] ABSTRACT

An air flow control system for the dampers of the individual offices or rooms in a group of offices or rooms sharing a common air supply duct with a thermostatic control in but a single one of the offices or rooms. The system includes a motor operated damper in each room or office, the motor being controlled to shut the damper when a signal from a remote transmitter is received by a receiver in a control circuit with the motor. The transmitter is selectively actuated by the individual occupying the particular room or office. The control circuit is activated when the signal is received by the receiver, and after a delay period automatically sends a signal to drive the motor to reopen the damper. The occupant may thus control the closing of the damper when the temperature of the air through the supply duct causes the room to be uncomfortable, and need not be concerned about reopening the damper.

3 Claims, 1 Drawing Sheet

AIR FLOW DAMPER CONTROL SYSTEM

BACKGROUND OF THE INVENTION

This invention relates to a system for controlling the air flow dampers in the environmental control system of a multi-room building, and more particularly to a system for such control wherein rooms in the same air flow circuit as a room having a thermostat control may temporarily shut flow communication to the rooms selectively.

In multi-room buildings, such as office buildings, it is generally found that a thermostat in one office or room controls the environmental conditions, such as temperature, of other offices within a given zone. For example, a group of offices generally share a given air flow duct circuit, with one office of the group having the only thermostat control. Thus, the person residing in that one office, by setting the thermostat at a temperature comfortable to him or her at a particular time, dictates the temperature of the other offices. Since people have varying metabolism rates it would be unusual for everyone in the same group to desire the same conditions at the same time, and generally a number of people in the group will not be comfortable. If, for example, the controlling person selects the temperature high on a winter morning, a number of the people in the group may be excessively warm. It is not unusual for the controlling person to set the temperature at one setting in the morning and thereafter change the setting as he or she begins to feel uncomfortable with the original setting. Each change in the setting has varying effects on the other people in the group, and may interrupt their work if they periodically shut and open the damper in their office a number of times during the day.

Although separate thermostats may be placed in each office, the cost for such a system would be prohibitive. The same is true to a large extent if thermostatic control of the air dampers in each office were used to open and close the individual dampers. Additionally, although remote damper controls have been proposed wherein the damper in an office may be closed or partially closed by the resident remotely while at his or her desk, it is inconvenient to have to change the damper positions periodically, first to get less air and then to get more air. It is highly desirable to make the change and then go back to work without having to remember to rechange the damper setting later or when it becomes uncomfortable due to too little air flow.

SUMMARY OF THE INVENTION

Consequently, it is a primary object of the present invention to provide a control system for the air flow dampers and thus the air flowing to the individual rooms or offices of a group in the same air flow circuit as a room or office having a thermostatic control and wherein the remainder of the group do not have a thermostatic control.

It is another object of the present invention to provide individual control systems for the offices in a group sharing the same environmental air flow duct work circuit where only one of the group has a thermostatic control, the system having damper controls in the other offices for closing the respective damper selectively and for opening the damper automatically after a short time delay.

It is a further object of the present invention to provide remotely controlled air dampers for each room or office of a group in the same air flow circuit as another room or office having a thermostatic control, the damper control being individually selectable to shut the air flow to the respective room or office by the occupant thereof, and having means for automatically reopening the damper without imposing that burden on the individual occupying the room or office.

Accordingly, the present invention provides an air flow control system for the dampers of the individual offices or rooms in a group of offices or rooms sharing a common air flow duct circuit with a thermostatic control in but a single one of the offices or rooms, the system including a motor operated damper in each office or room, the motor being controlled to shut the damper when signaled by a remote transmitter at the selection of the individual occupying the office or room through a receiver in a control circuit with the motor, the control circuit having time delay means for driving the motor to reopen the damper after a selected time delay period.

In this manner the resident or occupant of one room or office in the air circuit with a room or office having a thermostatic control, may control the closing of the damper in his or her room or office when the temperature of the air flowing through the air duct system causes the room temperature to be uncomfortable. Generally such a closing need only be for a short time period since after that period the thermostat will shut the air flow in the entire air circuit and thus the present invention, after a time delay, reopens the closed damper automatically and the occupant of the one room or office need not remember to open the damper. Of course, should the air temperature revert back to that when the damper was originally shut, and the occupant again becomes uncomfortable, he or she need only reactivate the closing of the damper merely be engaging a conveniently located portable transmitter.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
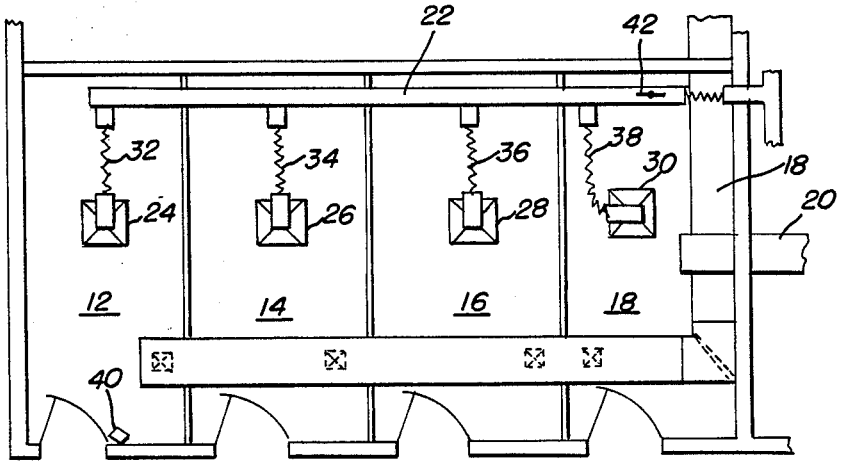
FIG. 1 is a fragmentary floor plan of a typical office group incorporating apparatus according to the principles of the present invention.
Figure 2:
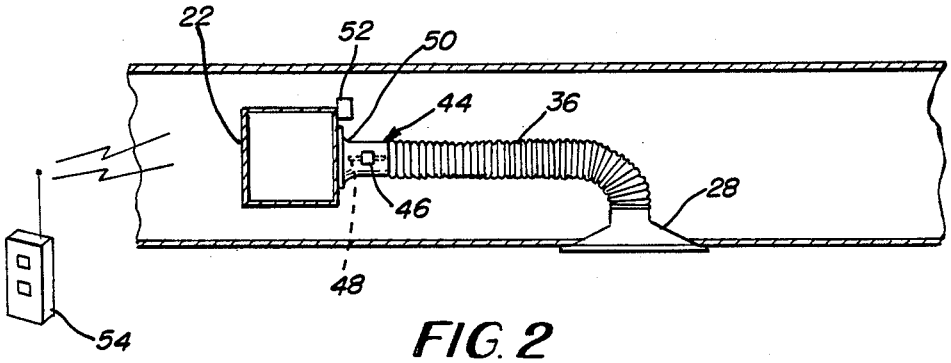
FIG. 2 is a fragmentary cross sectional view taken substantially through a ceiling in a typical one of the offices not having a thermostat illustrated in FIG. 1.

Referring to the drawings, FIG. 1 illustrates a typical suite of offices comprising, for example, a group of four individual offices 12, 14, 16 and 18, supplied with environmentally controlled air from a common supply duct 18 receiving air from a main supply duct 20. A branch line 22 supplies the air to an outlet 24, 26, 28, 30 through respective flexible conduits 32, 34, 36, 38 in each respective office 12, 14, 16, 18. Conventionally, in such an office group, only a single thermostat 40 located in one of the offices, e.g., office 12, controls a main damper 42 in the supply such as branch line 22, and this air flows through all four offices. If, for example, on a cold winter morning the resident or occupant of office 12 turns the thermostatic setting up high, the high temperature air is permitted to flow past the open damper 42 throughout the branch 22 into each office until the temperature in office 12 reaches the set value and the thermostat 40 acts to shut the damper 42. In such instances the residents of offices 14, 16, and 18 have no control over the air flowing into their respective office unless they shut the vanes within the respective outlet 26, 28, 30 which, as illustrated are usually in the ceiling and difficult to reach. Additionally, if the resident of, for example, office 16 after shutting the flow in the outlet 28 begins to get cold he or she must again get up and open the outlet. Obviously, this presents an inefficient system and results in an unproductive waste of time.

The present invention provides a simple cost effective and inexpensive system for alleviating a substantial amount of such inefficiency by providing a motor controlled damper 44 in the ducting leading from the common branch 22 to the respective outlet, for example outlet 28, the motor 46 and the damper valve 48 preferably being mounted within a coupling such as a bell-mouth coupling 50. The motor 46 may be actuated to shut the valve 48 upon receipt of an electrical signal from a receiver 52 in the electrical circuit with the motor as hereinafter described, the receiver 52 receiving a radio frequency control signal from a portable transmitter 54 placed at a convenient location such as on the desk of the occupant of each of the offices such as in office 16. The receiver 52 and transmitter 54 may be conventional units such as a Chamberlain Model 100 LM receiver and Model 54 LM transmitter manufactured by the Chamberlain Consumer Product Group, Division of Duchossois Industries, Inc. of Elmhurst, Ill. Since it would be undesirable for the office occupant to reopen the valve 48 periodically after shutting it, the present invention also provides a time delay in the circuitry between the receiver 52 and the motor 46, the time delay permitting the valve 48 to be closed for a given time and then to automatically reopen so that air may again flow through the outlet 28.

Figure 3:
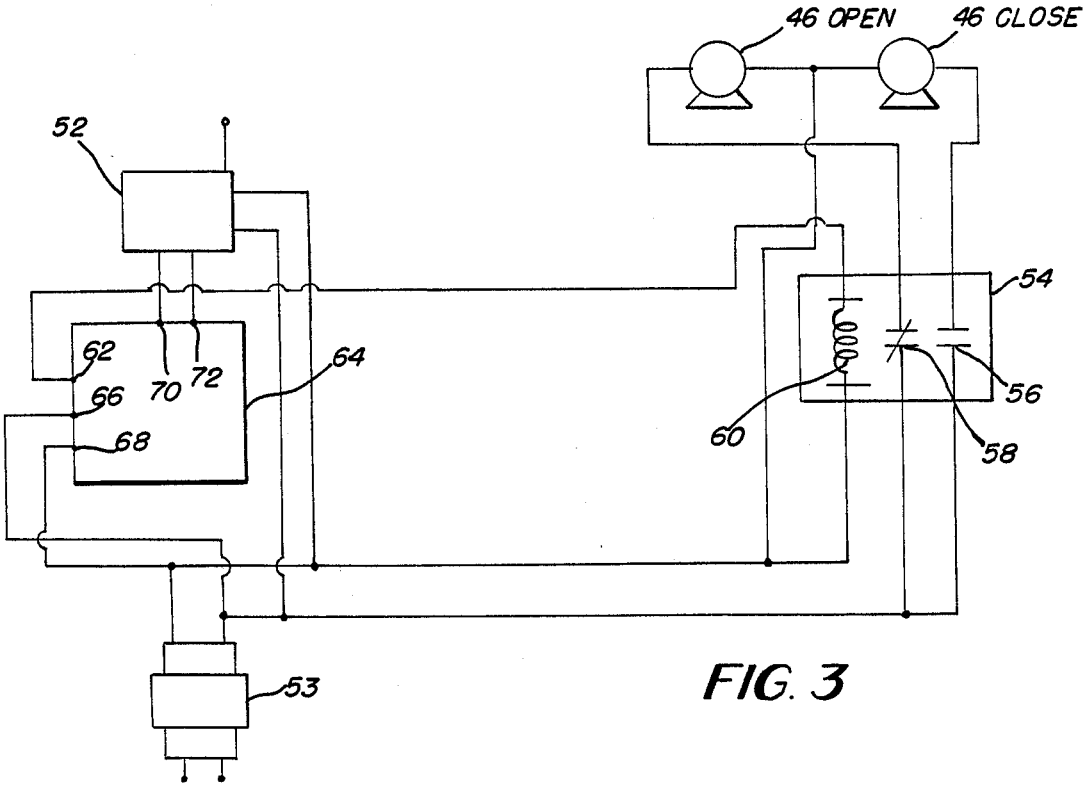
FIG. 3 is a schematic view of the electrical circuitry for controlling the dampers according to the present invention.

Referring to FIG. 3, a preferred form of the circuitry of the invention is disclosed, current being supplied from a conventional 115 to 120 volt a.c. supply or the like to the input side of a transformer 53 which drops the voltage to 24 volts for use with conventional relays. Although the output of the transformer may be d.c., in the preferred embodiment, an a.c. transformer is utilized since the motor 46 is a 24 VAC reversible gear motor rated at 10 VA and is a standard motor used in the heating and ventilating industry for driving a damper valve. The motor 46 is known in the art as a "stall motor" to which power is always supplied and has mechanical stops at the end of each rotational movement, i.e., it rotates in a first direction upon receipt of a signal and then stops when the mechanical stop in that direction is contacted. The motor then remains in the stall condition until a signal is transmitted to rotate it in the reverse direction. Thus, the open damper position of the motor is indicated in FIG. 3 in the circuit at 46 "open" while the closed damper position on the motor is indicated at 46 "close."

A relay 54 having a normally open contact 56 and a normally closed contact 58 is connected in the circuit to the motor with the normally open contact connected to the close damper direction terminal of the motor and with the normally closed contact connected to the open damper direction terminal, the relay coil 60 being connected between the transformer 53 and the output terminal 62 of the time delay relay 64.

The time delay relay 64 may be a conventional unit such as the Q3 series manufactured by National Controls Corporation of West Chicago, Ill., and has input voltage applied across input terminals 66, 68 at all times from the transformer.

As illustrated in FIG. 3, under normal conditions, the coil 60 of the relay 54 is not energized and the motor open terminal receives current and the damper is in the open position. When the occupant of the room or office signals the receiver 52 by means of the transmitter 54, a circuit is closed within the receiver 52 which energizes a start switch at terminals 70, 72. of the time delay relay 64. This energizes the output at terminal 62 which becomes connected internally to the input at terminal 66, and remains energized as long as the switch is closed to thereby energize the coil 60 of the relay 54 to open contacts 58 and close contacts 56. This permits current to flow to the motor close terminal resulting in the motor rotating in the direction which closes the damper 48, the motor stopping when it engages the mechanical stop in that direction. The time delay relay begins timing immediately upon opening of the start switch and acts to hold the contacts closed between the terminals 62 and 66 after the substantially momentarily closed receiver contacts have opened. At the end of the time delay period the output at the terminal 62 is deenergized and the motor open circuit is energized since the coil 60 no longer has current.

It is anticipated that the time delay should be in the order of approximately 8 to 12 minutes which would permit the temperature of the air in the affected room or office to change to that which is comfortable to the occupant prior to the damper reopening. Generally, by that time, the air in the conduit 22 which was controoled by the thermostat 40 would no longer be heated in the winter (or cooled in the summer), but even if it were the conditions in the room would have changed such that the occupant should feel comfortable with the air supplied from the conduit 22. If, at some later time, the occupant again feels the need to shut the damper, the cycle may be repeated.

Numerous alterations of the structure herein disclosed will suggest themselves to those skilled in the art. For example, rather than a.c. components, the system may use d.c. components, and the specific relays may be varied as desired. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A method for controlling the air temperature in a selected number of rooms in a group of rooms having a single air supply conduit including a flow control means controlled by a thermostat in only one of the group and each of the other rooms of the group having an individual damper valve for permitting air to flow from the conduit to an air supply outlet in the respective room, said method comprising:

(a) providing an electric motor and a control circuit for each of said individual damper valves for driving the respective valve open and closed, (b) selectively remotely signaling said control circuit to actuate the respective motor to drive the respective valve closed to shut the flow of air to a selected room, (c) providing a time delay in said circuit, and (d) automatically actuating the motor to drive the respective valve open after the time delay.

2. An airflow control system for selectively controlling a plurality of individual damper valves in a group of rooms sharing a common air supply conduit with another room having a thermostat control for opening and shutting the flow in the conduit, said system comprising an electric motor for each individual damper valve, circuit means for controlling each motor independently to shut the respective damper, said circuit means including a receiver controlled by a remote signal and time delay means for permitting said motor to reopen the damper automatically after a fixed time period, said system further including a transmitter for providing said remote signal selectively at the option of an occupant of the respective room to shut the damper.

3. In a building having an air supply conduit feeding temperature conditioned air to a group of rooms having air outlets in each of the rooms communicating with the conduit and wherein only one of the rooms has a thermostat control for opening and shutting the flow of air in said conduit, an air flow control system for the other of the rooms of the group, said system comprising a damper valve in flow communication with said conduit and a respective outlet in said other rooms, a reversible electric motor connected to said damper valve for driving said damper valve in a first direction to open said valve to permit air to flow through the outlet and in a second direction to close the valve to shut the flow of air to said outlet, electrical circuit means for controllably actuating said motor to drive the valve in said first and second directions selectively, said circuit means including a receiver controlled by a remote signal for actuating said motor to drive said valve in said second direction to close upon receipt of said signal, time delay means actuated by said receiver upon receipt of said signal for actuating said motor to drive said valve in said first direction to reopen said damper after a fixed time period, and a transmitter selectively located in said other of the rooms for selectively transmitting a control signal to the respective receiver.

* * * * *